US005694635A

United States Patent [19]

Earle et al.

[11] Patent Number: 5,694,635

[45] Date of Patent: Dec. 2, 1997

[54] PHOTOGRAPHIC PROCESSING APPARATUS

[75] Inventors: Anthony Earle, Harrow Weald; David Skye, Harpenden, both of England

[73] Assignee: Eastman Kodak Company, Rochester, N.Y.

[21] Appl. No.: 633,146

[22] Filed: Apr. 16, 1996

[30] Foreign Application Priority Data

Apr. 18, 1995 [GB] United Kingdom ..... 9507846

[51] Int. Cl.[6] ..... G03D 3/02

[52] U.S. Cl. ..... 396/578; 396/626

[58] Field of Search ..... 354/298, 317–324; 396/578, 620–626, 630, 631, 641, 43, 45, 47; 137/565, 551, 556, 556.3, 558

[56] References Cited

U.S. PATENT DOCUMENTS

| | | | |
|---|---|---|---|
| Re. 30,610 | 5/1981 | Gacki et al. | 366/153 |
| 3,978,506 | 8/1976 | Geyken et al. | 354/324 |
| 4,263,932 | 4/1981 | Laar et al. | 137/101.2 |
| 4,480,901 | 11/1984 | Osegowitsch et al. | 396/626 |
| 5,199,594 | 4/1993 | Obara et al. | 220/403 |
| 5,511,569 | 4/1996 | Mukogawa | 134/104.1 |

FOREIGN PATENT DOCUMENTS

| | | | |
|---|---|---|---|
| 0 227 358 B1 | 12/1986 | European Pat. Off. | G03C 3/06 |
| 0 500 371 A2 | 2/1992 | European Pat. Off. | G03D 3/06 |
| 0 488 207 | 6/1992 | European Pat. Off. | G03D 3/13 |
| 2647919 | 5/1990 | France | G03D 3/06 |
| 1363136 | 8/1970 | United Kingdom | G03D 3/06 |
| 1454994 | 11/1976 | United Kingdom | G05D 9/00 |
| WO91/18326 | 5/1990 | WIPO | G03D 3/06 |

*Primary Examiner*—D. Rutledge
*Attorney, Agent, or Firm*—Charles E. Snee, III

[57] ABSTRACT

Described herein is a buffer device for use with photographic processing apparatus which provides a buffer for solution being fed to or collected from the apparatus. The buffer device (18) comprises a flexible plastic concertina-shaped container (30) having a volume appropriate to the apparatus with which it is to be used. The container (30) is preferably constructed to be normally-closed and requires liquid pressure to open it. The container (30) is fixed at its upper end (38) and its lower end (40) is free to move downwardly when liquid enters it. An index member (32) is attached to the lower end (40) and this member (32) cooperates with a position sensor to indicate to an operator whether the container (30) is "not empty", "not full" or "full".

7 Claims, 2 Drawing Sheets

PHOTOGRAPHIC PROCESSING APPARATUS

FIELD OF THE INVENTION

The present invention relates to improvements in or relating to photographic processing apparatus and is more particularly, although not exclusively, concerned with the replenishment of processing solutions in such processing apparatus.

BACKGROUND OF THE INVENTION

In photographic processing machines, photosensitive material is processed or treated by wetting it with processing chemicals. Normally, this takes place in large tanks or trays which are replenished frequently with replenisher solutions to keep the processing activity constant.

However, there is a tendency to reduce the size of such tanks or trays and, as a result, the volumes of processing solutions are also reduced. This means that the tanks or trays normally only have enough chemical capacity to process photosensitive material for short periods of time without upsetting the consistency of the results obtained. It is evident, therefore, that tanks or trays of lower volumes do not have any chemical capacity reserve, and as a result, the replenishment of the processing solutions becomes more critical if the processing activity is to be maintained within predetermined limits.

PROBLEM TO BE SOLVED BY THE INVENTION

With advent of new photosensitive films and papers which are susceptible to small changes in processing solution activity or concentration when being processed in conventional tanks or trays having volumes of up to about 20l, there is a need to ensure that processing solutions in these tanks or trays are replenished regularly.

SUMMARY OF THE INVENTION

It is therefore an object of the present invention to provide an arrangement which enables such replenishment to be carried out without loss in processing activity of the processing solutions.

In accordance with one aspect of the present invention, there is provided processing apparatus for processing photosensitive material, the apparatus comprising:

at least one processing tank;

at least one receptacle connected to a respective one of the processing tanks; and control means for controlling the flow of processing solution between each receptacle and a respective one of the processing tanks;

characterized in that the control means includes a buffer device for providing an indication of the status of the receptacle, the buffer device being connected between a receptacle and a respective one of the processing tanks.

By the term "receptacle", is meant any sealed, flexible storage container which contains processing solution for supply to a processing tank.

ADVANTAGEOUS EFFECT OF THE INVENTION

By providing a buffer of processing solution in accordance with the present invention, photographic processing can continue whilst exhausted chemical supplies are being changed. This is especially important in the processing of process-sensitive materials and low volume processing tanks.

The present invention is also useful where large areas of photosensitive material are to be processed and there is a likelihood that the replenishing solution supply may run out or become exhausted. This would lead to sensitometric variations over the material being processed.

BRIEF DESCRIPTION OF THE DRAWINGS

For a better understanding of the present invention, reference will now be made, by way of example only, to the accompanying drawings in which.

DETAILED DESCRIPTION OF THE INVENTION

One aspect of the present invention relates to a flexible container which is fitted between a processing tank and a replenisher storage container. In particular, it is desired that the replenisher storage container comprises a sealed, flexible container. When the replenisher storage container is empty, it is sucked flat by a metering pump connected thereto for pumping replenisher solution from the replenisher storage container to the processing tank. As the pump continues to run, it starts to draw solution from the flexible container, which collapses thereby continuing to supply replenisher to the processing tank and sending out an alarm which indicates to an operator that the replenisher storage container must be changed.

In another aspect, the flexible container is connected between the processing tank and an effluent container by means of a conduit. The flexible container operates to provide a buffer for effluent as the effluent container is filled and effluent starts to back up to the conduit towards the processing tank. Again, an alarm is given which indicates that the effluent container must be changed.

In each case, the replenisher storage and effluent containers are connected with non-drip connectors which close when the containers are disconnected from the conduit connecting them to the processing tank.

On the inlet side to the processing tank, this maintains a negative pressure in the supply line so that the solution continues to be drawn from the flexible container. When a new replenisher supply is connected the non-drip valves in the connector open allowing the flexible container to expand and refill ready for the next change.

Figure 1:
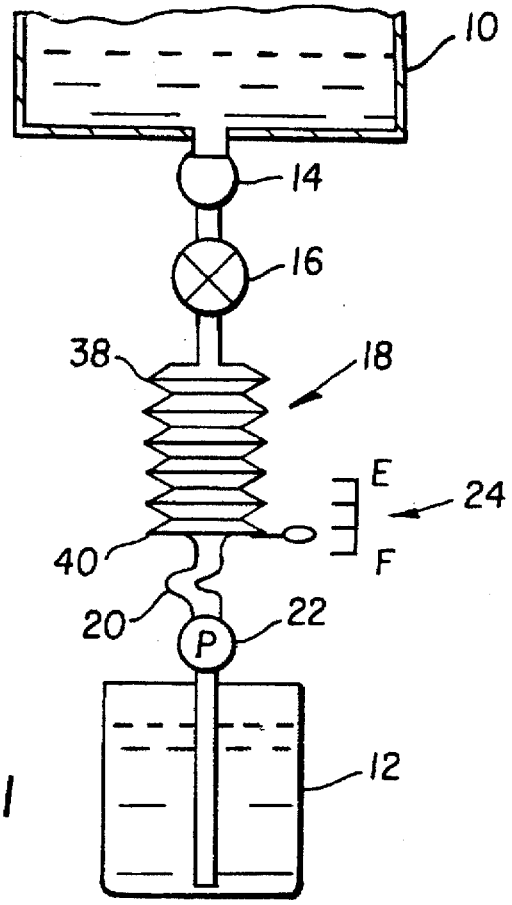
FIG. 1 is schematic illustration of a process utilising a solution buffer device in accordance with the present invention.

Referring initially to FIG. 1, a processing tank 10 is shown connected a replenisher storage container 12 via a flow sensor 14, a valve 16, a buffer device 18 in accordance with the present invention, a length of flexible tubing 20, and a pump 22. The flow sensor 14 provides a feed into the processing tank 10 and although shown as a direct feed thereto, it may be also be part of a recirculation system (not shown).

Valve 16 separates the flow sensor 14 from the rest of the replenishment system as shown. Below the valve 16 is the buffer device 18 which in this embodiment is normally closed. Attached to the buffer device 18 is a position sensor 24 which could be an optical encoder, a linear potentiometer or any other suitable position sensing means. Below the buffer device 18, connected by the length of flexible tubing 20, is the pump 22 which draws solution from the replenisher storage container 12.

System control may be stand-alone or may be overseen by an embedded micro-controller (not shown).

When the buffer device 18 is empty, it will be closed and the position sensor 24 will indicate that state to the system control (not shown). This will cause the pump 22 to start to deliver solution from the storage container 12 to the buffer device 18. During the course of this action, the buffer device 18 will expand. There are two possible outcomes: namely, that the buffer device 18 will expand until the "full" condition is sensed by the position sensor 24 or the buffer device 18 does not reach the "full" condition within a predetermined time.

In the first case, when the buffer device 18 is full the pump 22 is switched off. When replenishment is called for, the valve 16 is opened and solution is forced by the action of the buffer device 18 through the flow sensor 14 into the processing tank 10 until the flow sensor 14 detects the specified quantity. The valve is then closed. During this action, the buffer device 18 will rise. If the attached position sensor 24 reaches the "not full" position then the pump 22 will be activated and the buffer device 18 will be filled. This sequence of events will continue until the supply storage container 12 is empty.

In the latter case, the storage container 12 is considered empty, and an alarm to that effect is generated indicating to an operator that the appropriate solution container needs to be changed. During that time, processing may continue and the replenishment needs satisfied by continued cycles of the valve 16 opening and solution being forced into the process through the flow sensor 14 by the contracting action of the buffer device 18.

The size of the buffer device 18 in relation to the replenishment needs of the process determines the length of time allowed to change the storage container 12.

Figure 2:
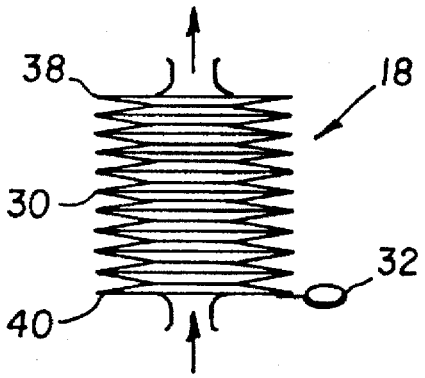
FIG. 2 is a schematic illustration of one embodiment of a solution buffer device in accordance with the present invention.

The buffer device 18 consists of a flexible plastic concertina-shaped container 30, as shown in FIG. 2, which has an index member 32 designed to cooperate with the position sensing means 24 (not shown in FIG. 2). Naturally, the index member 32 is chosen to be suited to the particular type of sensing means 24 employed. The volume of the container 30 is chosen in accordance with the process in which it is used. The container 30 may be constructed to be 'normally closed', as shown in FIG. 2, and requires a liquid pressure to open it. Solution flows through the container 30 in the direction of the arrows.

Figure 3:
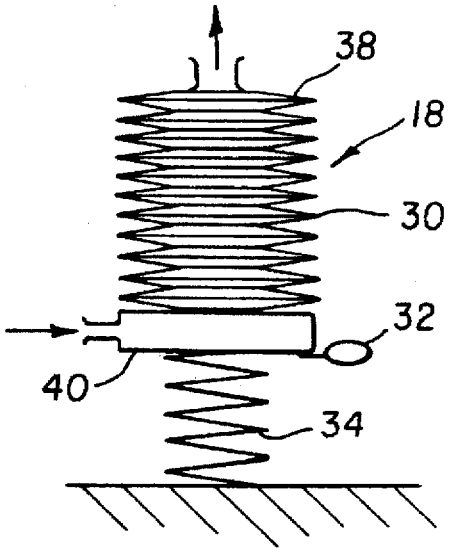
FIG. 3 is a schematic illustration of a second embodiment of a solution buffer device in accordance with the present invention.

Alternatively, the container 30 may be 'normally open' and requires an external force to close it as shown in FIG. 3. Here, a spring 34 is used to close the container 30.

Figure 4:
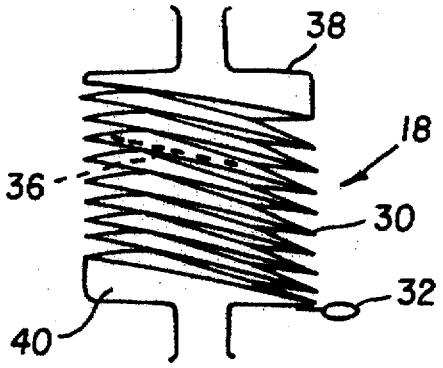
FIG. 4 is a schematic illustration of a third embodiment of a solution buffer device in accordance with the present invention.

Moreover, the container 30 could include an encapsulated spring 36 to help keep it either in a 'normally closed' or 'normally open' as shown in FIG. 4.

In each case, the index member 32 indicates if the buffer device 18 is "not empty", "not full" or "full". In the embodiments shown, top end 38 of the buffer device 18 is held in a fixed position whilst bottom end 40 is allowed to move up and down.

In a typical Graphics arts material process, the replenishment requirements may be up to about 420 ml/m$^2$ of material. The material width may be up to 760 mm and the transport speed of the material through the process may be up to 830 mm/min. Such a process will require approximately 267 ml of replenisher solution per minute. In this case, a 11 buffer device 18 will allow up to nearly 4 min to change the storage container 12. This time can be extended if the material width decreases or the replenishment requirements decrease with intelligent replenishment algorithms and new lower replenishment processes.

Figure 5:
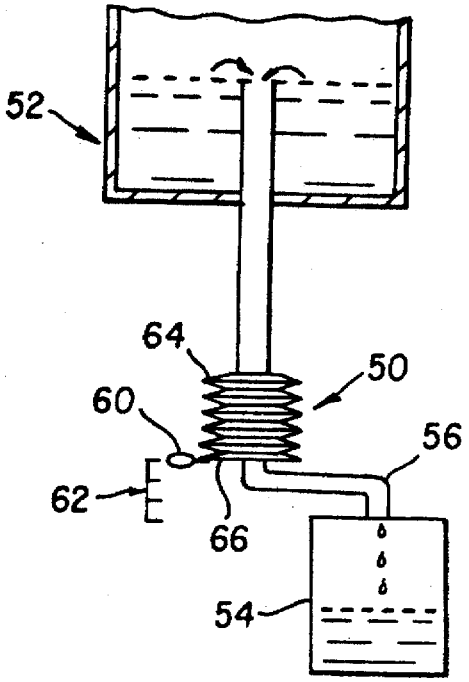
FIG. 5 is a schematic illustration of a solution buffer device connected to the effluent side of a photographic process.

As shown in FIG. 5, a buffer device 50 is shown on the effluent side of the process. A processing tank 52 is connected to an effluent collecting container 54 by means of flexible tubing 56 between the container 54 and the buffer device 50 and pipe 58 between the buffer device 50 and the processing tank 52. The buffer device 50 has an index member 60 which cooperates with a position sensor 62 as before.

The effluent buffer device 50 consists of a 'normally closed' device similar to that shown in FIG. 2, but with weaker closing force.

Figure 6:
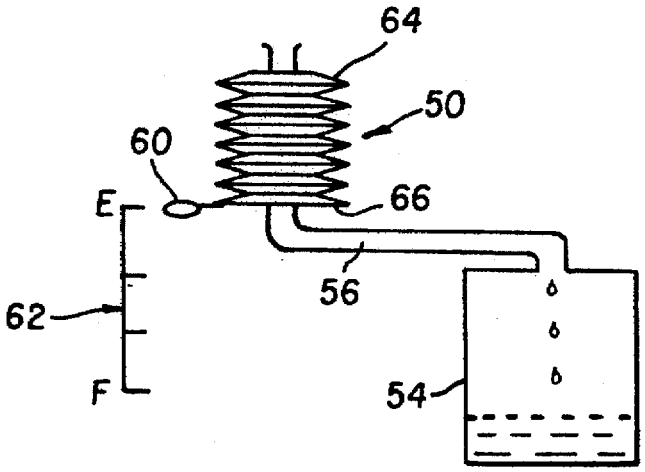
FIG. 6 is a similar to FIG. 5, but illustrating the device in its 'normal' state.

Top 64 of the buffer device 50 is held in a fixed position whilst bottom 66 is allowed movement through the flexible tubing 56. Effluent normally trickles down through the buffer 50 by Gravity and into the effluent collecting container 54. During this normal course of events, the buffer device 50 remains collapsed and the position sensor 62 indicates that condition. This is shown more clearly in FIG. 6.

Figure 7:
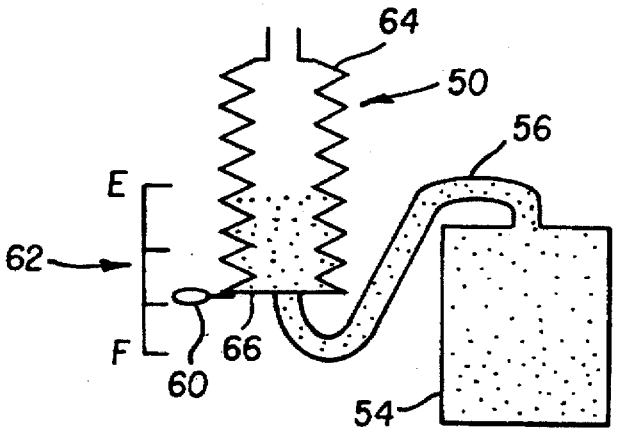
FIG. 7 is a similar to FIG. 5, but illustrating the device in its 'full' state.

When the effluent container 54 becomes full, FIG. 7, the effluent backs up the flexible tubing 56 until it reaches the buffer device 50. At this point the buffer device 50 starts to expand with the weight of liquid due to its weaker restoring force. The index member 60 moves down with bottom 66 until it reaches a "not empty" position as shown. An alarm will then be generated to indicate to an operator that the appropriate effluent container 54 is full and needs to be changed.

As the buffer device 50 continues to fill with the effluent there is only a very slight increase in solution head to the effluent container 54 as the device 50 is flexible.

The present invention is useful in processes which utilize 'bag-in-box' arrangements for both supplying solution to the process and collecting effluent therefrom as described in our copending U.S. patent application Ser. No. 08/632,992 filed concurrently herewith (corresponding to British patent application no. 9507845.7 filed on 18 Apr. 1995 entitled "Improvements in or Relating to the Handling of Solutions") and incorporated hereinby reference.

Naturally, it will be appreciated that the present invention is not limited to use in photoprocessing applications, but can be implemented in any other arrangement in which a sealed, flexible container is required to supply solution to apparatus for whatever purpose.

PARTS LIST

10 . . . processing tank
12 . . . storage container

14 . . . flow sensor
16 . . . valve
18 . . . buffer device
20 . . . flexible tubing
22 . . . pump
24 . . . position sensor
30 . . . concertina-shaped container
32 . . . index member
34 . . . spring
36 . . . encapsulated spring
38 . . . top end
40 . . . bottom end
50 . . . buffer device
52 . . . processing tank
54 . . . collecting container
56 . . . flexible tubing
58 . . . pipe
60 . . . index member
62 . . . position sensor
64 . . . top
66 . . . bottom

We claim:

1. Processing apparatus for processing photosensitive material, the apparatus comprising:

at least one processing tank;

at least one receptacle connected to a respective one of the processing tanks; and control means for controlling the flow of processing solution between each receptacle and a respective one of the processing tanks;

the control means including a buffer device comprising a flexible container for providing an indication of the status of the receptacle, the buffer device being connected between a receptacle and a respective one of the processing tanks.

2. Apparatus according to claim 1, wherein the flexible container is a flexible concertina-shaped container which carries an index member, the index member cooperating with a position sensor to provide the desired indication.

3. Apparatus according to claim 2, wherein the desired indication comprises an alarm signal.

4. Apparatus according to claim 1, wherein the buffer device is connected between a supply receptacle and its associated processing tank, the buffer device providing an indication that the receptacle is empty.

5. Apparatus according to claim 1, wherein the buffer device is connected between an effluent receptacle and its associated processing tank, the buffer device providing an indication that the receptacle is full.

6. Processing apparatus for processing photosensitive material, the apparatus comprising:

at least one processing tank;

at least one receptacle connected to a respective one of the processing tanks; and control means for controlling the flow of processing solution between each receptacle and a respective one of the processing tanks; the control means including a flexible container for providing an indication of the status of the receptacle, the flexible container being connected between a receptacle and a respective one of the processing tanks and carrying an index member, the index member cooperating with a position sensor to provide the indication.

7. The apparatus of claim 6, wherein the flexible container has a concertina shape.

* * * * *